US008425181B2

(12) United States Patent
Senoo

(10) Patent No.: US 8,425,181 B2
(45) Date of Patent: Apr. 23, 2013

(54) AXIAL-FLOW TURBINE WITH FLOW EXTRACTION MEANS

(75) Inventor: Shigeki Senoo, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 567 days.

(21) Appl. No.: 12/706,073

(22) Filed: Feb. 16, 2010

(65) Prior Publication Data

US 2010/0226768 A1 Sep. 9, 2010

(30) Foreign Application Priority Data

Mar. 3, 2009 (JP) ..... 2009-048720

(51) Int. Cl.
*F01B 25/00* (2006.01)

(52) U.S. Cl.
USPC ..... 415/144; 415/115; 415/169.4; 415/169.1; 415/182.1

(58) Field of Classification Search ..... 415/208.1, 415/115, 169.1–4
See application file for complete search history.

(56) References Cited

U.S. PATENT DOCUMENTS 6,986,638 B2 * 1/2006 Austin et al. ..... 415/115

FOREIGN PATENT DOCUMENTS

JP 2-241904 A 9/1990
JP 10-331604 A 2/1998

* cited by examiner

*Primary Examiner* — Nathaniel Wiehe
*Assistant Examiner* — Justin Seabe
(74) *Attorney, Agent, or Firm* — Mattingly & Malur, PC

(57) ABSTRACT

The axial-flow turbine includes an extraction chamber 15 disposed on the outer circumference of a turbine blade chamber 12 and an extraction opening 16. An outer diaphragm 8 forming the downstream-side wall surface of the extraction chamber 15 is provided with a projection 21 formed more radially inwardly than the downstream-side edge on the outer circumference of an adjacent bucket 2 on the upstream side of the extraction opening 16 to form the downstream-side wall surface of the extraction opening 16. The projection 21 forms an upstream-side wall surface 18 of the outer diaphragm 8 for leading a part of the working fluid to the extraction chamber 15, and an inner wall surface 19 of the outer diaphragm 8 for leading the remaining working fluid to a bucket 11 on the downstream side of the extraction opening 16.

3 Claims, 8 Drawing Sheets

4
15
8
18
12b
19
23
11
10
21
12
9
9a
Z
X
20
16
d
NH
BH
13
Y
7
7b
2
5
5b
3
8
6a
β1
β2
β3
β4

AXIAL-FLOW TURBINE WITH FLOW EXTRACTION MEANS

BACKGROUND OF THE INVENTION

1. Field of the Invention

The present invention relates to an axial-flow turbine such as a steam turbine and a gas turbine. More particularly, the invention relates to an axial-flow turbine having an extraction structure for extracting a part of a working fluid.

2. Description of the Related Art

An axial-flow turbine is axially provided with a plurality of stages composed of stationary blades and buckets. In operation, a working fluid in such an axial-flow turbine may be extracted between stages for use as a heat source or for use to drive a rotating machine.

For example, with steam turbines, steam is extracted between stages and then led to a feedwater heater or deaerator. Then, this steam goes out a steam turbine outlet and is subjected to heat exchange with water which is in a liquid phase formed by condensing by using a steam condenser. This process raises the temperature of water before the water is returned to a heater such as a boiler and a nuclear reactor, thus improving power generation efficiency.

There are steam turbines of combined heat and mechanical power cogeneration type or combined heat and electric power cogeneration type. Such steam turbines aim at driving an industrial rotating machine such as a pump and driving a generator and at the same time providing high-temperature and high-pressure steam as a heat source. During operation of these steam turbines, it is necessary to extract steam as a heat source from between stages.

A typical axial-flow turbine having such an extraction structure is provided with a circular-shaped extraction chamber disposed on the outer circumference of a turbine blade chamber in which steam flows. That is, the extraction chamber circumferentially extends around the turbine blade chamber. This extraction chamber and the turbine blade chamber in which steam flows are connected with each other through a slit-shaped extraction opening circumferentially formed toward an outer wall of the turbine blade chamber. A part of the working fluid in the turbine blade chamber is extracted into the extraction chamber through the extraction opening, and then transmitted to a predetermined place via an extraction pipe connected with the extraction chamber (refer to JP-2-241904-A).

SUMMARY OF THE INVENTION

However, when an extraction chamber and an extraction opening are provided on the outer wall side of a turbine blade chamber, an outer circumferential component of a working fluid flows out from an adjacent bucket on the upstream side of the working fluid flow of the extraction opening (hereinafter simply referred to as the upstream side) is extracted mainly as an extraction flow. Therefore, a flow from a blade height position which is more radially inward than the outer circumference of the bucket on the upstream side of the extraction opening enters the outer circumference of a stage composed of a stationary blade on the downstream side of the working fluid flow (hereinafter simply referred to as the downstream side) of the extraction opening and a bucket. This flow, while advancing from the bucket on the upstream side of the extraction opening through the stationary blade on the downstream side of the extraction opening to the bucket on the downstream side of the extraction opening, changes its course radially outwardly (hereinafter simply referred to as outwardly). Therefore, a portion to which the working fluid flow is not sufficiently supplied may arise, at an outward entrance of the stationary blade on the downstream side of the extraction opening. At the portion to which the working fluid flow is not sufficiently supplied, an unstable flow may arise resulting in an eddy current. This causes kinetic energy for essentially producing torque to thermally run away possibly resulting in degraded turbine efficiency.

It is known that increasing the number of stages in the turbine blade chamber, decreasing the average diameter of the working fluid channel of the turbine blade chamber, and employing a small-diameter multistage structure are effective for improving turbine efficiency. However, decreasing the diameter of the turbine rotating shaft and increasing the shaft length degrades the shaft rigidity and increases shaft vibration, possibly resulting in such a problem that the stator comes in contact with the rotor. On the other hand, increasing the number of stages within a limited shaft span decreases the size of the extraction opening and the extraction chamber, making it impossible to obtain a sufficient extraction flow rate. With a multistage axial-flow turbine having an extraction structure, in comparison with an axial-flow turbine without extraction, it is necessary to decrease the number of stages to provide extraction openings suited to the extraction flow rate. Therefore, turbine efficiency may decrease.

An object of the present invention is to provide an axial-flow turbine having an extraction structure, which prevents a decrease in turbine efficiency caused by extraction and provides as many turbine stages as possible within the limited shaft span to improve turbine efficiency.

In order to attain the above-mentioned object, the present invention forms a projection on the outer diaphragm which forms the downstream-side wall surface of the extraction chamber. The projection is formed more radially inwardly than the downstream-side edge on the outer circumference of the adjacent bucket on the upstream side of the extraction opening to form the extraction opening. Specifically, the present invention is attained by each of the appended claims.

According to the present invention, an axial-flow turbine having an extraction structure makes it possible to restrain disturbance of a steam flow on the downstream side of the extraction opening to prevent reduction in turbine efficiency. Accordingly, restrictions on the design extraction quantity can be alleviated.

Further, the axial width of the extraction structure can be reduced to increase the number of stages, thus improving turbine efficiency.

DESCRIPTION OF THE PREFERRED EMBODIMENTS

The basic structure of turbine stages of a common axial-flow turbine will be described below with reference to FIG. 1.

Figure 1:
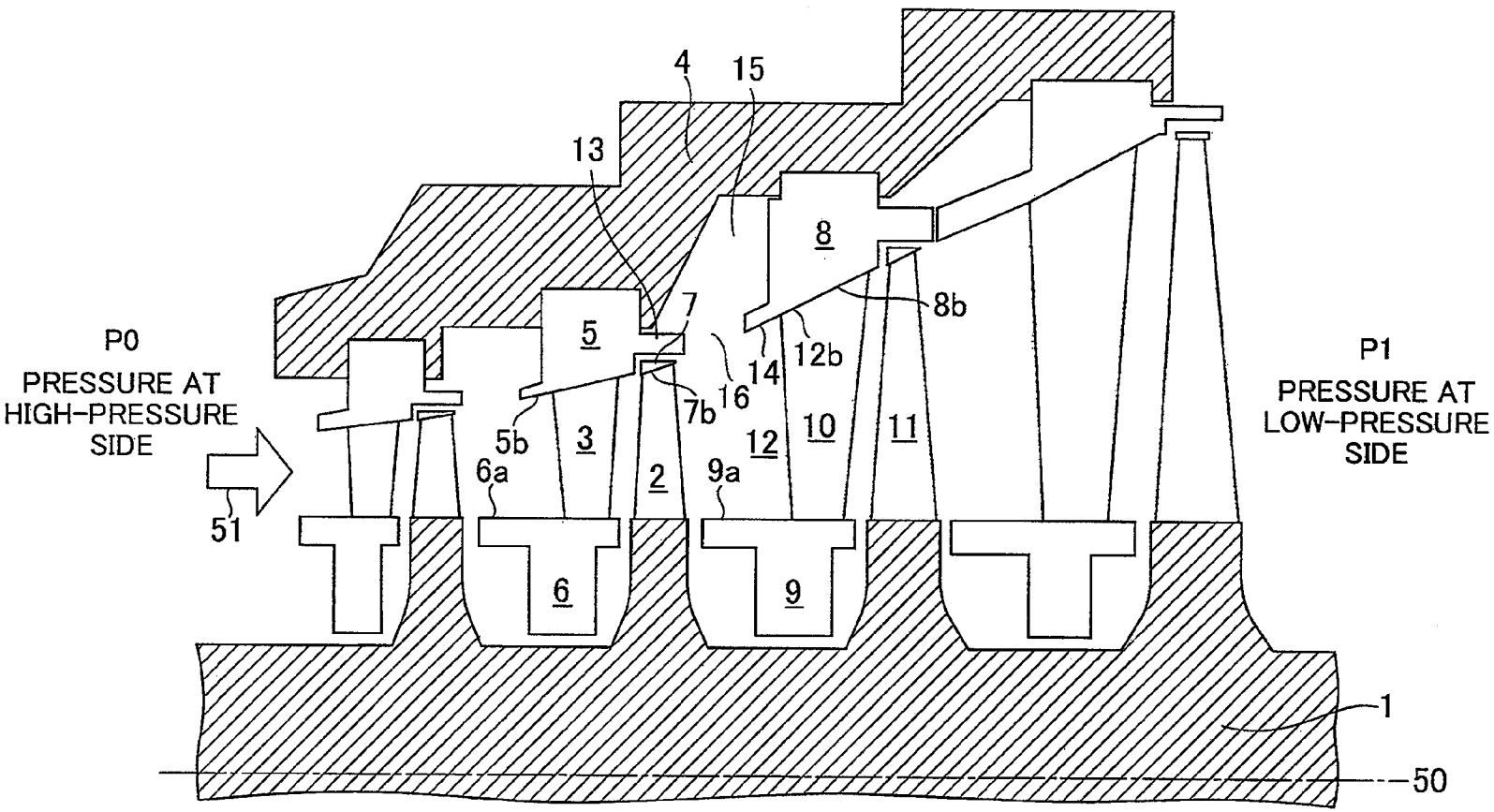
PRIOR ART FIG.1
FIG. 1 is a sectional view of a basic structure of turbine stages of a common axial-flow turbine.

As illustrated in FIG. 1, turbine stages of the axial-flow turbine are disposed between a high-pressure portion P0 on the upstream side of a working fluid flow (hereinafter simply referred to as the upstream side), and a low-pressure portion P1 on the downstream side of the working fluid flow (hereinafter simply referred to as the downstream side). A turbine stage is composed of a stationary blade 3 fixedly installed between an outer diaphragm 5 fixedly installed on the inner circumference of a turbine casing 4 and an inner diaphragm 6, and a bucket 2 disposed on a turbine rotor 1 which rotates around a turbine central axis 50. With an axial-flow turbine composed of a plurality of turbine stages, this stage structure is repeated along the working fluid flow a plurality of times. In each stage, a bucket is disposed on the downstream side of a stationary blade in an opposed manner with each other.

A shroud 7 is disposed on the radially outer edge (hereinafter simply referred to as the outer edge) of the bucket 2. As illustrated in FIG. 1, the axial-flow turbine includes a turbine blade chamber 12 having a cylindrical or partially conical shape in which a working fluid flow is formed. The turbine blade chamber 12 is formed of the turbine rotor 1, radially outer wall surfaces (hereinafter simply referred to as outer wall surfaces) 6*a* and 9*a* of respective inner diaphragms 6 and 9, outer diaphragms 5 and 8, and radially inner wall surfaces (hereinafter simply referred to as inner wall surfaces) 5*b* and 8*b* of respective outer diaphragms 5 and 8 and 7*b* of the shroud 7.

As illustrated in FIG. 1, the inner wall surfaces 5*b* and 8*b* of the respective outer diaphragms 5 and 8, and the inner wall surface 7*b* of the shroud 7 are consecutively installed to form an outer wall surface 12*b* of the turbine blade chamber 12. A circular extraction chamber 15 is formed on the outer circumference of the turbine blade chamber 12, i.e., between the outer wall surface 12*b* and the turbine casing 4 in the circumferential direction (hereinafter simply referred to as circumferentially) so as to enclose the turbine blade chamber 12. A extraction pipe (not illustrated) is connected to a part of the extraction chamber 15.

As illustrated in FIG. 1, the extraction chamber 15 is formed between the outer diaphragms 5 and 8. A gap is provided circumferentially between the downstream side end 13 of the outer diaphragm 5 and the upstream side end 14 of the outer diaphragm 8 which are consecutively installed along the direction of the working fluid flow. This gap forms an extraction opening 16 through which the extraction chamber 15 communicates with the turbine blade chamber 12.

Figure 2:
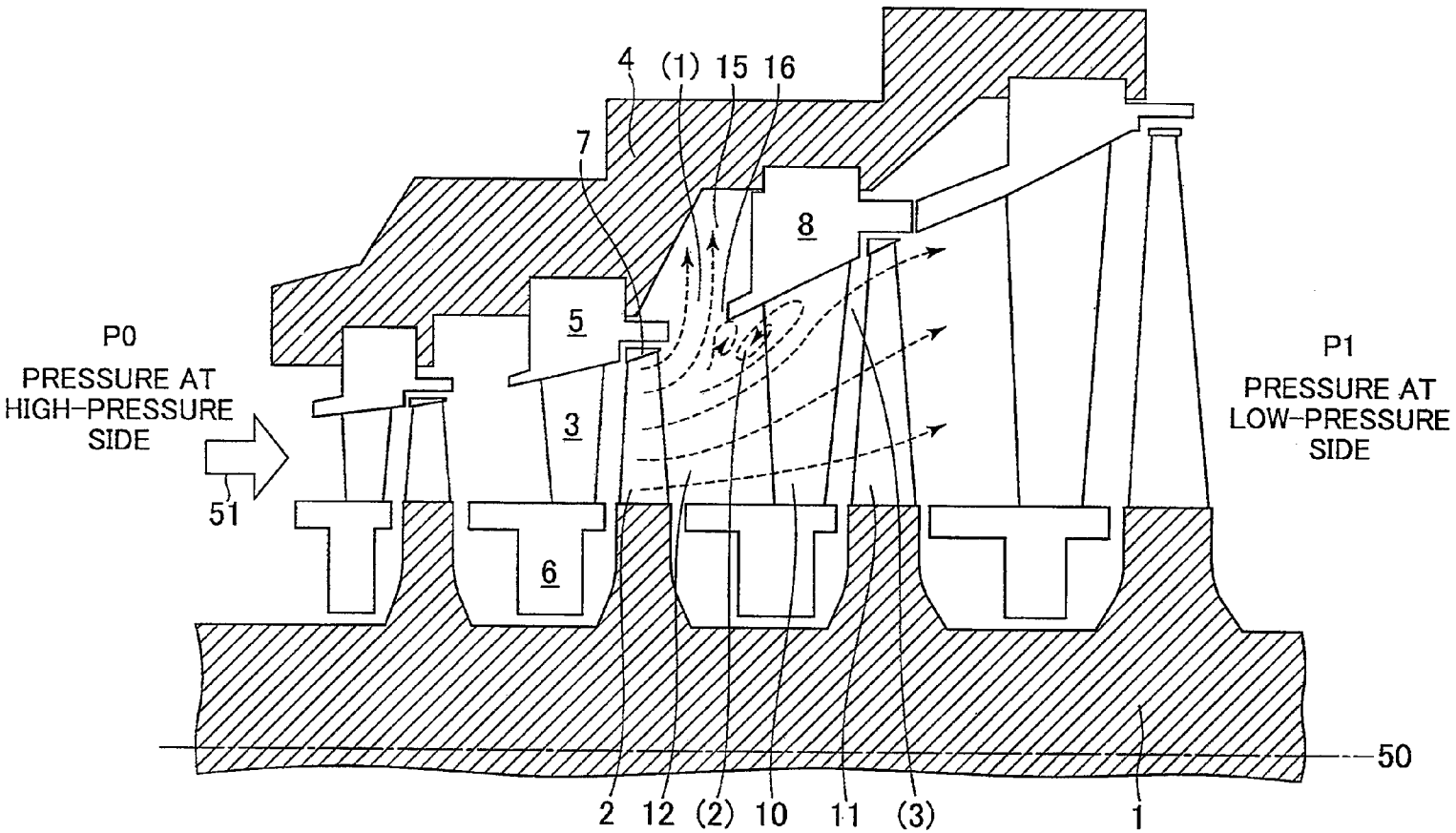
PRIOR ART FIG.2
FIG. 2 is a schematic view of a working fluid flow in the axial-flow turbine illustrated in FIG. 1.

FIG. 2 schematically illustrates the working fluid flow in the axial-flow turbine illustrated in FIG. 1. An arrow 51 denotes the direction of the working fluid flow.

As illustrated in FIG. 2, when the extraction opening 16 is provided on the outer wall surface of the turbine blade chamber 12, the working fluid flowing out from the vicinity of the outer edge of the adjacent bucket 2 on the upstream side of the extraction opening 16 is extracted mainly as an extraction flow (1) into the extraction chamber 15 through the extraction opening 16. Therefore, a working fluid (3), after passing through the blade height position which is more radially inward than the extraction flow (1) which is from the vicinity of the outer edge of the bucket 2, flows in the vicinity of the outer wall surface of the turbine blade chamber 12 on the downstream side of the extraction opening 16. The working fluid (3), while advancing from the bucket 2 through a stationary blade 10 of the following stage to the entrance of the bucket 11, changes its course outwardly. Therefore, particularly with high extraction flow rates, a portion (2) to which the working flow is not sufficiently supplied may arise at an outward entrance of the stationary blade 10. At the portion (2) to which the working fluid is not sufficiently supplied, an unstable flow commonly arises possibly resulting in an eddy current. This causes kinetic energy for essentially producing torque to thermally run away possibly resulting in degraded turbine efficiency.

Taking the above into consideration, an embodiment of the axial-flow turbine of the present invention will be described below.

Figure 3:
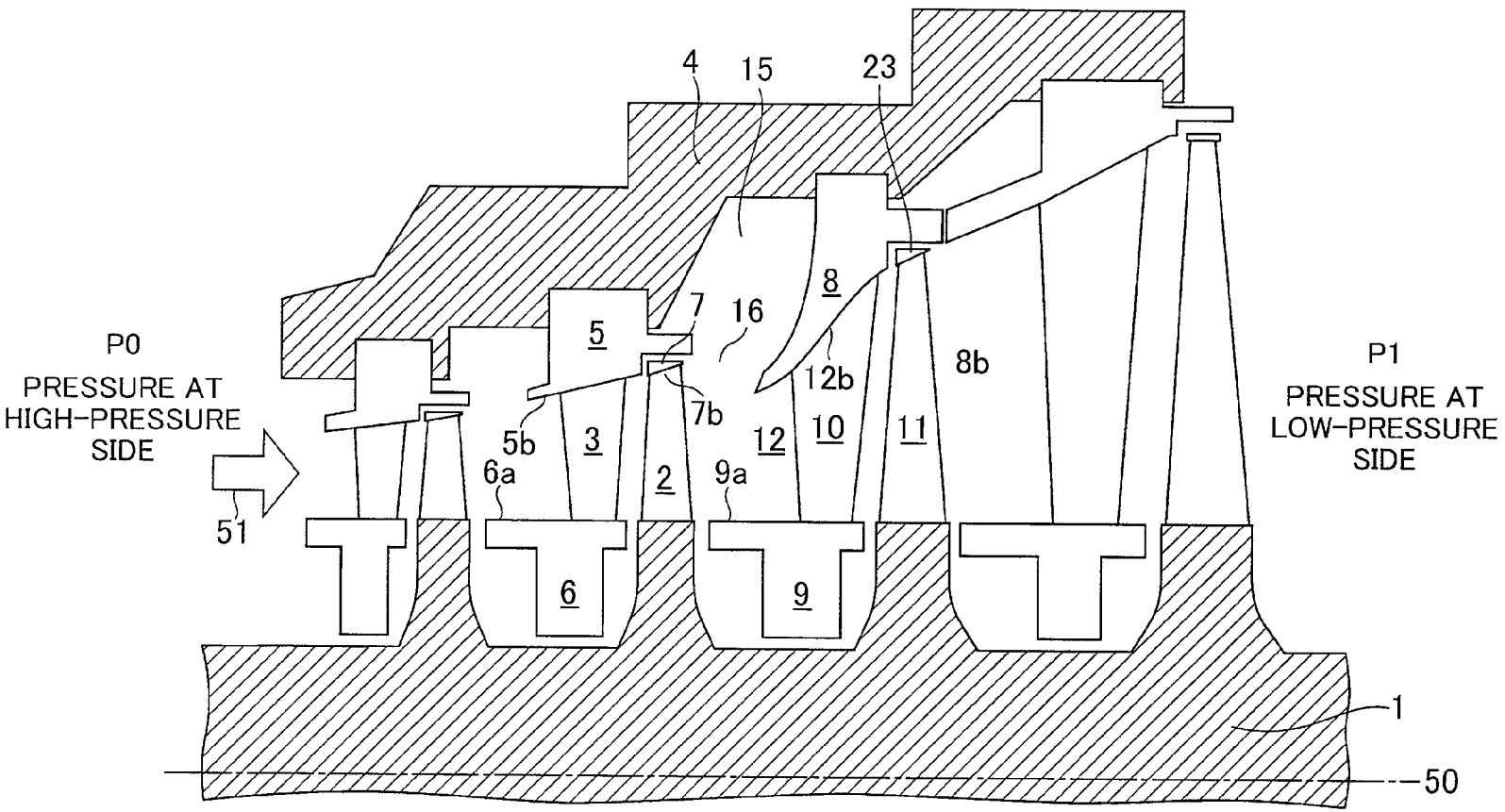
FIG. 3 is a sectional view of an essential part of turbine stages of an axial-flow turbine according to an embodiment of the present invention.
Figures 4A, 4B:
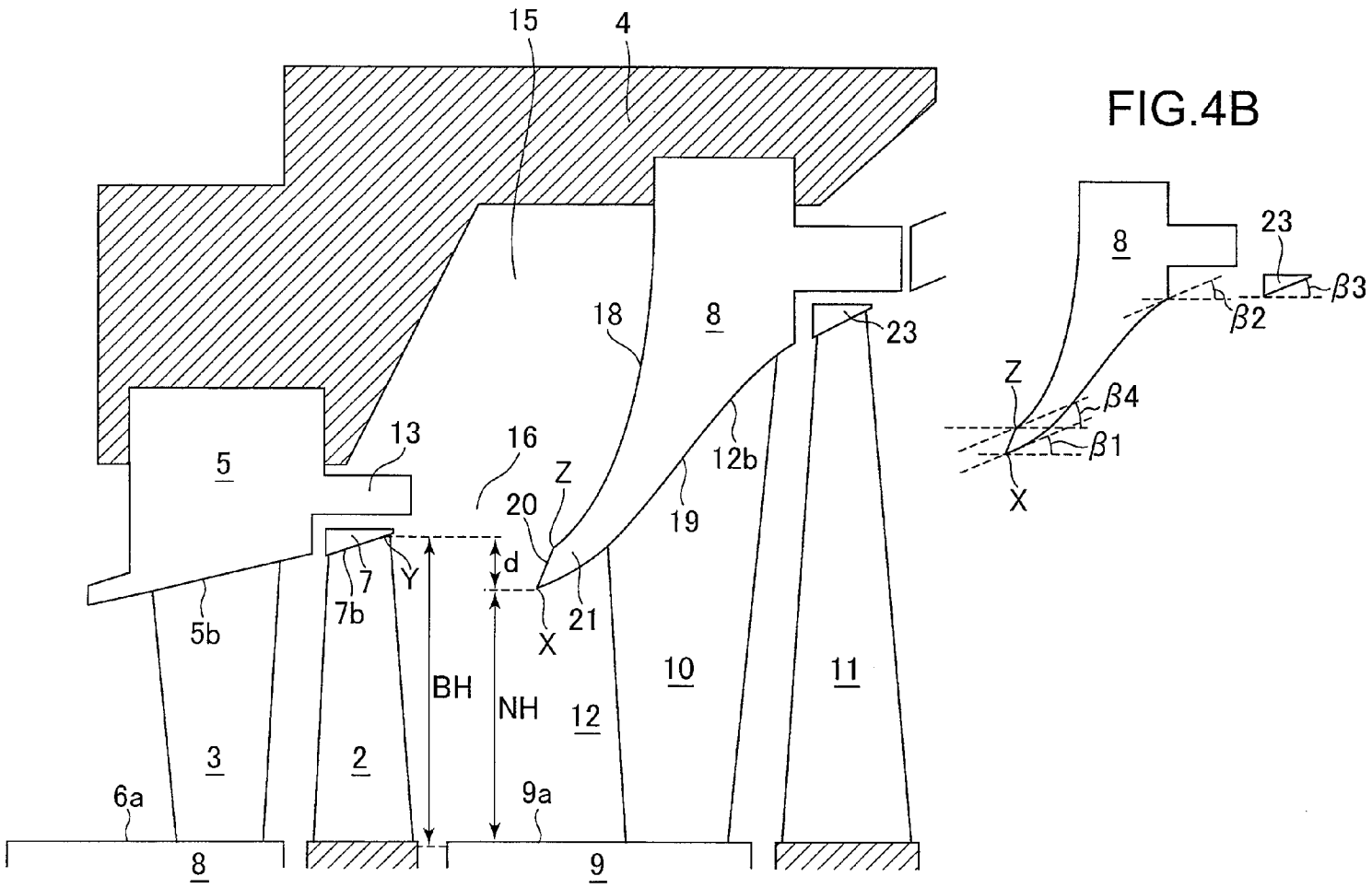
FIGS. 4A and 4B are enlarged views of the vicinity of an extraction chamber of the axial-flow turbine illustrated in FIG. 3.
Figure 5:
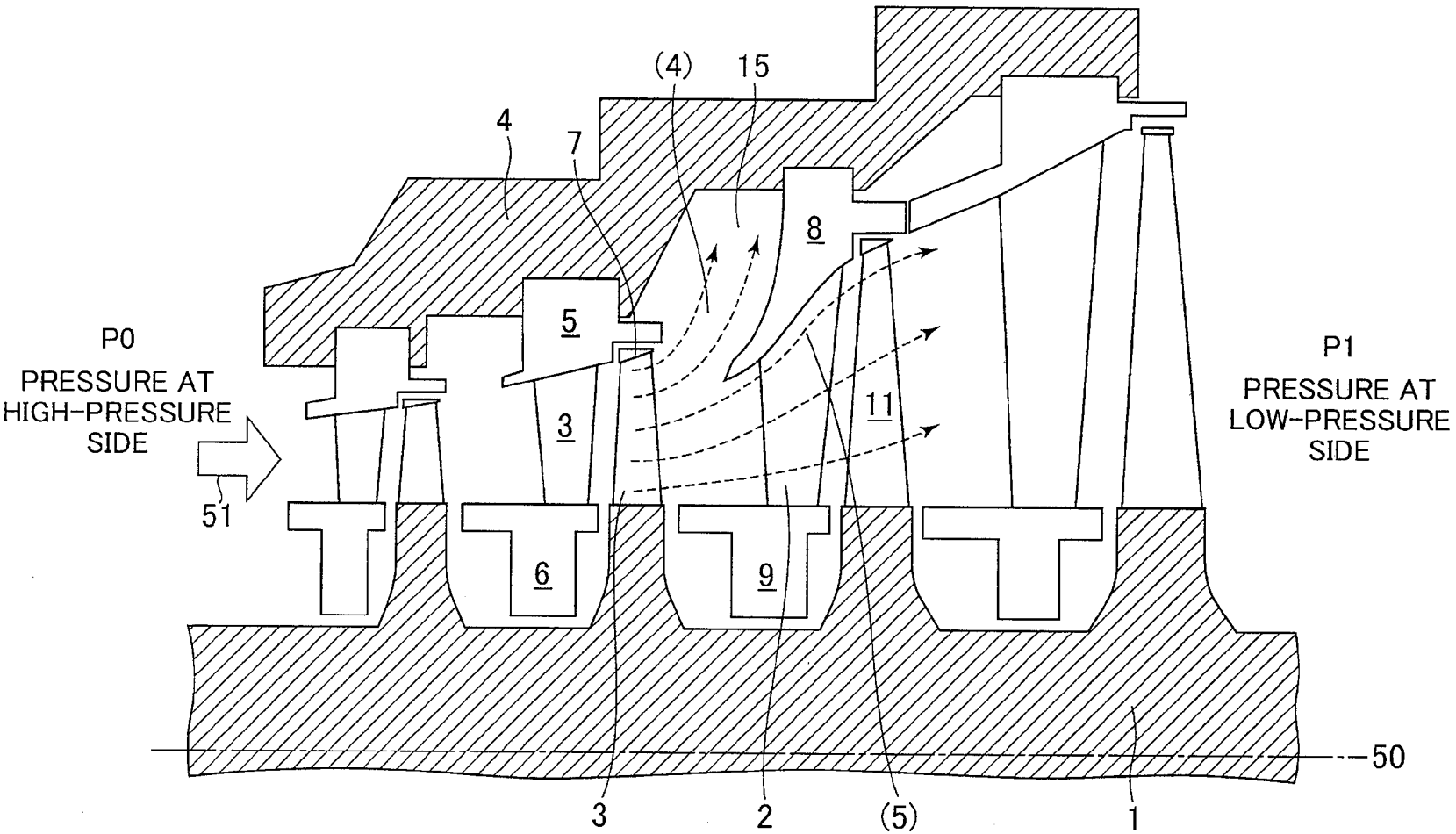
FIG. 5 is a schematic view of a working fluid flow in the axial-flow turbine according to the present invention illustrated in FIG. 3.

FIG. 3 is a sectional view of an essential part of turbine stages of the axial-flow turbine according to the present embodiment. FIGS. 4A and 4B are enlarged views of the vicinity of an extraction chamber of the axial-flow turbine illustrated in FIG. 3. FIG. 5 schematically illustrates the working fluid flow in the axial-flow turbine according to the present invention illustrated in FIG. 3. In FIGS. 3 to 5, elements equivalent to those in FIGS. 1 and 2 are assigned the same reference numeral and therefore duplicated explanations will be omitted.

As illustrated in FIG. 4A, the outer diaphragm 8 which forms the downstream-side wall surface of the extraction chamber 15 has an upstream-side wall surface 18 facing the extraction chamber 15 and an inner wall surface 19 facing the working fluid mainstream and forming the outer wall surface 12*b* of the turbine blade chamber. The inner wall surface 19 is formed so that the distance between the turbine central axis 50 and an upstream-side edge X, i.e., a radius of the turbine, becomes shorter than the distance between the turbine central axis 50 and a downstream-side edge Y on the outer circumference of the adjacent bucket 2 on the upstream side of the extraction opening 16. Further, as illustrated in FIG. 5, the upstream-side wall surface 18 is concaved toward the outer circumference and upstream sides so that an extraction flow (4) is smoothly led to the extraction chamber 15. The upstream-side wall surface 18 and the inner wall surface 19 form a consecutive surface through an end face 20. The end face 20, an edge of the upstream-side wall surface 18 in contact with the end face 20, and an edge of the inner wall surface 19 in contact therewith form a projection 21 which forms the downstream-side wall surface of the extraction opening 16.

The inner edge of the projection 21 is formed so that it projects out more on the upstream side than the outer edge, thus reducing the resistance at a bifurication point of the working fluid. The inner edge of the projection 21 denotes the upstream-side edge X of the inner wall surface 19. The outer edge of the projection 21 denotes the upstream-side edge Z of the upstream-side wall surface 18. Therefore, the projection 21 is formed more radially inwardly than the downstream-side edge on the outer circumference of the adjacent bucket on the upstream side of the extraction opening.

Cross-sectional shapes of the upstream-side wall surface 18 and the inner wall surface 19 of the outer diaphragm 8 will be described below in more detail. For convenience of subsequent descriptions, an angle formed between the wall surface facing the working fluid and the turbine central axis 50 is referred to as a "spread angle."

As illustrated in FIG. 4B, a spread angle β1 at the upstream-side edge X of the inner wall surface 19 of the outer diaphragm 8 is determined through numerical fluid analysis and tests such that it suits the streamline of the working fluid flowing from the upstream side. Commonly, a spread angle β1 is made smaller than the average spread angle for a range from the upstream- to downstream-side edges of the inner wall surface 19. On the other hand, a spread angle β2 at the downstream-side edge of the inner wall surface 19 is adjusted to an entrance spread angle β3 of the outer edge of the bucket 11 to transfer the flow to the adjacent bucket 11 on the downstream side. In this way, the shape of the inner wall surface 19 is determined by using, for example, a third order function with given coordinates and angles at the upstream and downstream-side edges.

Each spread angle on the inside wall surface 19 denotes an angle formed between an axial tangent (illustrated by a dashed line of FIG. 4B) on the inner wall surface 19 and the turbine central axis. The entrance spread angle on the outer edge of the bucket 11 denotes an inclination angle with respect to the turbine central axis 50 at the upstream-side edge on the outer circumference of the bucket 11.

In order to orient the working fluid flow, which is axially spreading as it advances, outwardly on the upstream-side wall surface 18 of the outer diaphragm 8, a spread angle β4 at the upstream-side edge Z of the upstream-side wall surface 18 is determined through numerical fluid analysis and tests, in a similar way to the inner wall surface 19, such that it suits the streamline of the working fluid flowing from the upstream side. The upstream-side wall surface 18 is formed such that the spread angle thereof gradually increases with increasing distance from the upstream-side edge toward the downstream-side so as to gradually orient the working fluid flow outwardly as it advances toward the extraction chamber.

Each spread angle on the upstream-side wall surface 18 denotes an angle formed between an axial tangent (illustrated by a dashed line of FIG. 4B) on the upstream-side wall surface 18 and the turbine central axis 50.

As illustrated in FIG. 4A, a ratio of a length d to a blade height BH of the upstream-side bucket 2, d/BH, is determined so that a ratio of an extraction flow rate GEX to a stage flow rate G, GEX/G, becomes almost the same as a ratio of a circular area A2 to a circular area A1, A2/A1. The length d denotes an amount of projection (or radial distance) by the upstream-side edge X (inner edge of the projection 21) of the inner wall surface 19 from the downstream-side edge Y of the outer edge of the upstream-side bucket 2. The stage flow rate G denotes a flow rate in the downstream side stage of the extraction opening formed by the stationary blade 10 and the bucket 11 determined by the turbine specifications. The circular area A1 denotes an area of a circular portion formed by an entrance height NH of the downstream side stage. The circular area A2 denotes an area of a circular portion formed by an entrance size d of the extraction chamber.

Designing based on the circular area ratio according to each specification requirement in this way can avoid the eddy current (2) illustrated in FIG. 2 and accordingly eliminate the influence of extraction on the flow field regardless of the amount of extraction according to design specifications. Specifically, the larger the ratio of the extraction flow rate to the stage flow rate, the more effective the present invention and accordingly the larger the amount of improvement in turbine performance relative to the conventional structure.

FIG. 5 schematically illustrates a flow field of the axial-flow turbine according to the present invention. An extraction flow (4) is smoothly led to the extraction chamber 15 by the outer concave portion (upstream-side wall surface 18) of the outer diaphragm 8 which serves as a flow guide. A flow (5) is also smoothly led to the following stage, that is, toward the inner circumference of the outer diaphragm 8 by the inner wall surface 19. This makes it possible to reduce loss caused by the eddy current (2) produced in the conventional structure illustrated in FIG. 2, thus improving turbine efficiency. The extraction flow is selectively extracted from the outer circumference by the outer diaphragm 8.

Figure 6:
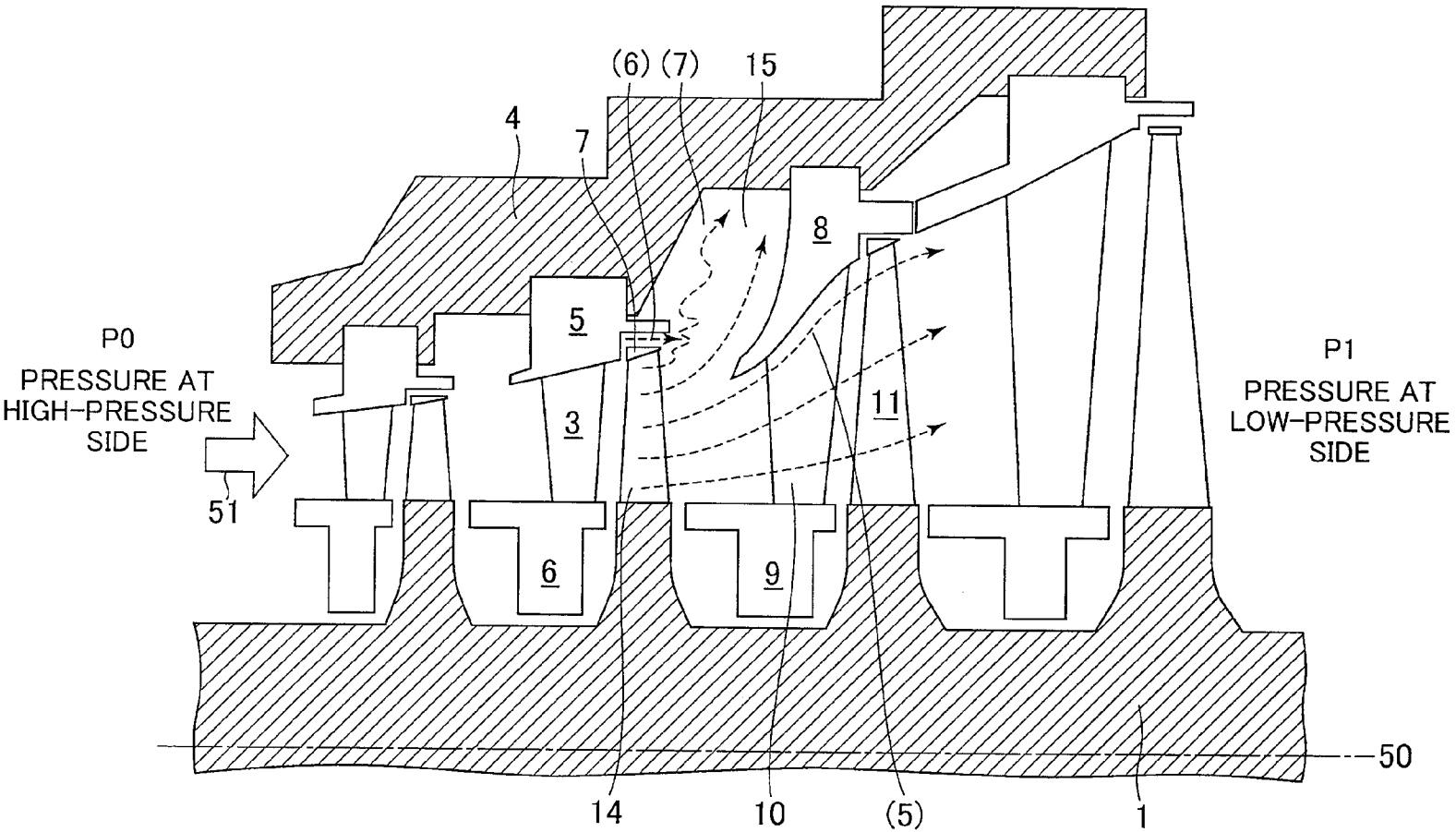
FIG. 6 is a schematic view of a behavior of a leak flow between a bucket and a stator in the axial-flow turbine according to the present invention illustrated in FIG. 3.

As illustrated in FIG. 6, a fluid flow on the outer circumference of the turbine blade chamber 12 contains a leak flow (6) between the bucket outer circumference and the stator (outer diaphragm) and a flow (7) having much disturbance by interference between the leak flow (6) and the working fluid mainstream coming from between buckets. When the flow (7) having much disturbance enters the downstream stage, turbine efficiency may decrease. With the turbine structure according to the present invention, an outer circumferential flow containing the flow (7) having much disturbance can be selectively extracted, preventing reduction in efficiency of the downstream stage. Further, the leak flow (6) has large enthalpy since it does not work on the bucket 2. This leak flow is advantageous when the extraction flow is utilized as a heat source.

Further, in a low-pressure stage of a steam turbine, a gas-liquid two-phase flow containing liquid-phase water arises. When the liquid phase (water film) on the blade surface is released as coarse water drops, erosion may occur on the downstream stage or loss may be caused, resulting in reduced turbine efficiency. The water film on the blade surface of the bucket 2 is biased outwardly by the centrifugal force caused by bucket rotation. Therefore, with the turbine structure according to the present invention which allows steam flow to be selectively extracted from the outer circumference, the liquid-phase water is removed from the steam turbine flow. This improves the reliability through reduced erosion as well as the performance through reduced moisture loss.

Although it is effective to increase the number of turbine stages to improve the performance, increasing the rotor span reduces the rotor rigidity. This arouses a problem such as an increase in vibration. Therefore, it is necessary to increase the number of turbine stages with restrictions on the rotor span, that is, reduce the axial width of each stage.

Figure 7:
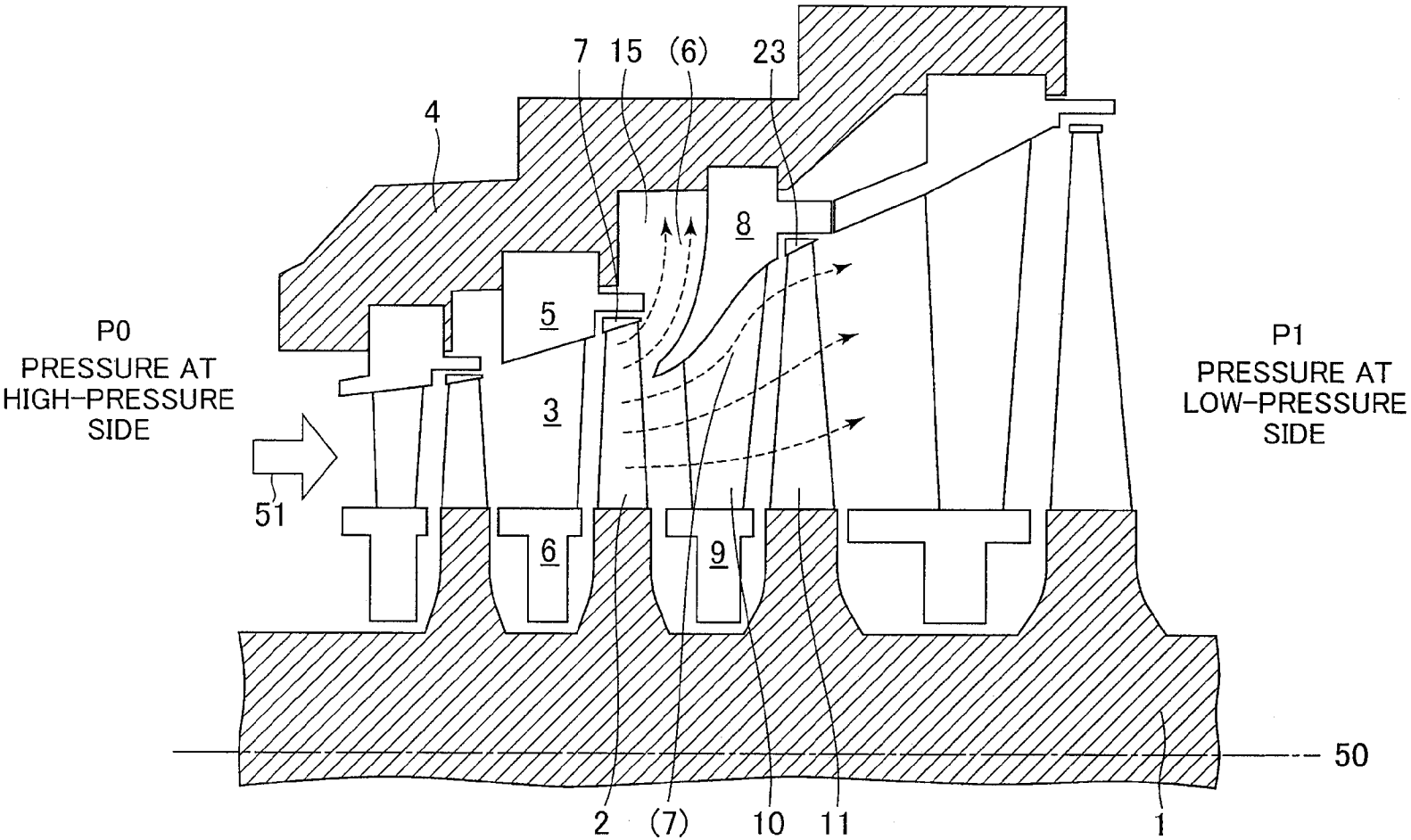
FIG. 7 is a sectional view of an essential part of turbine stages of an axial-flow turbine according to an embodiment of the present invention.
Figure 8:
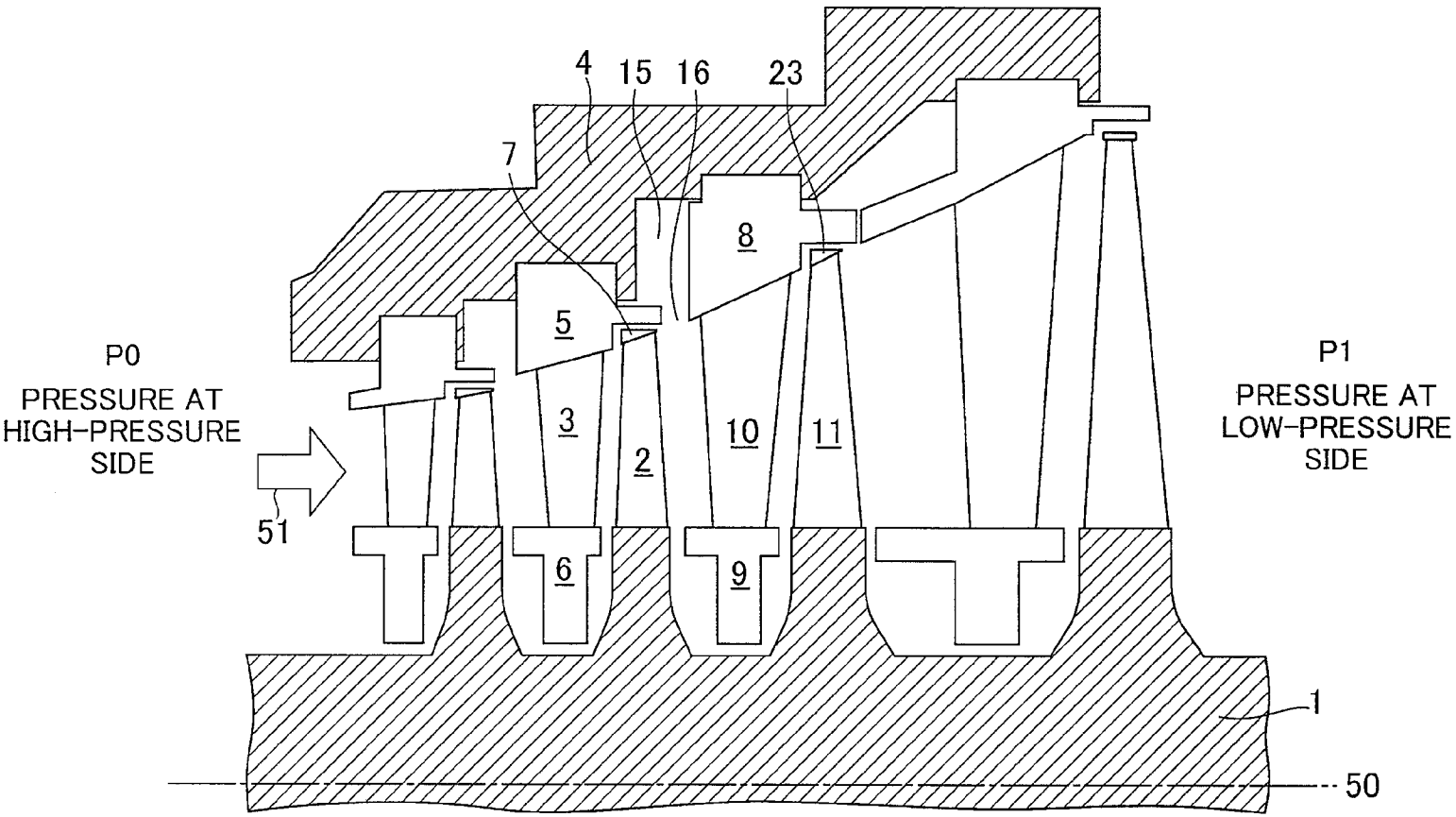
FIG. 8 is a sectional view of an essential part of turbine stages of the common axial-flow turbine illustrated in FIG. 1 when the shaft length is reduced.

FIG. 7 schematically illustrates fluid flows in an axial-flow turbine having reduced inter-stage distance according to the present invention. As illustrated in FIG. 8, with the conventional structure where the extraction opening 16 is axially formed, reducing the inter-stage distance makes it impossible to provide the extraction opening 16 having a sufficient size. In contrast, with the structure according to the present invention, the extraction opening 16 can be radially formed, thus eliminating the need of providing a space for the extraction opening 16 between stages. Since the extraction flow can be lead to the extraction chamber 15 by using the space of the outer diaphragm 8 of the stationary blade 10, a number of stages can be provided within the same shaft span. Accordingly, the enthalpy drop per stage can be reduced. Further, a decrease in diameter makes it possible to increase the blade length and reduce not only loss by leak flow but also secondary flow loss by the effect of a side wall boundary layer, thus improving turbine efficiency.

What is claimed is:

1. An axial-flow turbine, comprising:

a turbine blade chamber in which a working fluid flow is formed;

an outer diaphragm which is consecutively installed plurality of numbers along the working fluid flow to form an outer wall surface of the turbine blade chamber;

a turbine stage including a stationary blade disposed on the outer diaphragm and a bucket fixed to a rotor; and an extraction chamber provided on the outer circumference of the turbine blade chamber, the extraction chamber communicating with the turbine blade chamber through an extraction opening formed between the outer diaphragms consecutively installed along the working fluid flow, and having a downstream-side wall surface formed by the outer diaphragm;

wherein the outer diaphragm forming the downstream-side wall surface of the extraction chamber is provided with a projection, the projection being formed more radially inwardly than the downstream-side edge on the outer circumference of an adjacent bucket on the upstream side of the extraction opening to form the downstream-side wall surface of the extraction opening, wherein the outer wall surface of the projection forms the upstream-side wall surface of the outer diaphragm for leading a part of the working fluid to the extraction chamber, and the inner wall surface of the projection forms the inner wall surface of the outer diaphragm for leading the remaining working fluid to the bucket on the downstream side of the extraction opening, wherein the upstream-side wall surface of the outer diaphragm is formed such that a spread angle thereof gradually increases with increasing distance from the entrance of the extraction opening toward inside of the extraction chamber, and wherein the inner wall surface of the outer diaphragm is formed such that the spread angle thereof at the upstream-side edge is smaller than an average spread angle for a range from the upstream-side edge to downstream-side edge, and the spread angle thereof at the downstream-side edge is substantially equal to an entrance spread angle of the outer edge of an adjacent bucket on the downstream side.

2. The axial-flow turbine according to claim 1, wherein a ratio of a projection amount (or radial distance) of the inner edge of the projection toward radially inward direction from the downstream-side edge height of the outer edge of the bucket on the upstream side of the extraction opening to the blade height of the bucket on the upstream side of the extraction opening is equivalent to the ratio of an extraction flow rate to a stage flow rate.

3. The axial-flow turbine according to claim 1, wherein the working fluid is steam.

* * * * *